United States Patent [19]
Coq
[11] 4,379,465
[45] Apr. 12, 1983

[54] PROCESS FOR PRODUCING A FILTERING STRUCTURE IN PARTICULAR FOR CIGARETTE FILTERS

[75] Inventor: Francois Coq, Perpignan, France

[73] Assignee: Job, anciens Ets Bardou Job & Pauilac, Perpignan, France

[21] Appl. No.: 171,569

[22] Filed: Jul. 23, 1980

[30] Foreign Application Priority Data

Jul. 27, 1979 [FR] France ..... 79 19269

[51] Int. Cl.[3] ..... A24D 3/02; A24D 3/04; A24D 3/06

[52] U.S. Cl. ..... 131/332; 131/341; 131/342; 131/343; 131/345

[58] Field of Search ..... 131/341, 343, 332, 342, 131/345

[56] References Cited

U.S. PATENT DOCUMENTS

| | | | |
|---|---|---|---|
| 2,916,038 | 12/1959 | Wade | 131/343 |
| 3,039,908 | 6/1962 | Parmele | 131/343 |
| 3,229,008 | 1/1966 | Harrington et al. | 131/343 |
| 3,297,041 | 1/1967 | Sproull et al. | 131/343 |

FOREIGN PATENT DOCUMENTS

| | | | |
|---|---|---|---|
| 1028926 | 12/1952 | Fed. Rep. of Germany | 131/343 |
| 1126744 | 6/1955 | France | 131/343 |
| 1446575 | 6/1965 | France | 131/343 |
| 1497402 | 10/1966 | France | 131/343 |
| 1553779 | 9/1967 | France | 131/343 |
| 450993 | 5/1968 | Switzerland | 131/343 |
| 322609 | 4/1970 | Switzerland | 131/343 |

OTHER PUBLICATIONS

Chem. Abstracts, vol. 90, No. 23, 6/79, Ref. 183447b, p. 362 and JP-A-78-145,999; Ref. 183445z, p. 362 and JP-A-78-145,998.

*Primary Examiner*—V. Millin
*Attorney, Agent, or Firm*—Andrus, Sceales, Starke & Sawall

[57] ABSTRACT

Process for producing a filtering structure, in particular for cigarette filters from a fibrous mass comprising a homogeneous mixture of fibres of different types. Some of the fibres are necessarily thermofusible synthetic fibres having a low melting point and adhesive properties in the molten state, and the others are absorbent with respect to harmful products of tobacco smoke and stable at the melting temperature of the thermofusible fibres. The fibrous mixture is shaped into a cylindrical rod which is in state which is not yet coherent but homogeneous and comprises fibrous networks which are closely imbricated relative to each other. According to the invention, the process comprises employing a notable proportion of thermofusible fibres relative to the absorbent fibres, bringing the fibrous mixture to a temperature which leaves the absorbent fibres intact but which is high enough to melt and fluidify all the thermofusible material which, initially present in the form of fibres, is converted into fine droplets dispersed in the network of absorbent fibres. This conversion created, on one hand, multiple connections at the crossing points of the absorbent fibres, which remained stable and, on the other hand, a network of pores which intercommunicate in all directions and are constituted by spaces left empty upon the melting of the thermofusible fibres.

This process is applicable in particular to the production of a filtering structure for cigarette filters.

19 Claims, 3 Drawing Figures

PROCESS FOR PRODUCING A FILTERING STRUCTURE IN PARTICULAR FOR CIGARETTE FILTERS

The invention relates to a process for producing an isotropic filtering structure from a mass of fibrous material formed by a homogenous mixture of fibres of different types, the fibres of one of these types being necessarily thermofusible synthetic fibres, i.e. fibres obtained by known techniques from thermoplastic polymers, for example polyethylene one feature of which is to have relatively low melting point, the fibres of the other type being fibres which are stable at the melting temperature of the thermofusible fibres.

The fibrous mass may be shaped either in the form of slabs for the purpose of filtering solid or liquid particles of aerosols of smoke or dust in suspension in polluted air, or in the form of a cylindrical rod so as to constitute cigarette filters.

A process is already known for producing filter plugs which may be employed, for example as cigarette filters, obtained from fibrous masses such as whitened chemical wood pulp cellulose fibres or cotton wads which are interconnected by a liquid impregnation binder or a solid thermosealing binder as a powder or a fibre, which is added to the cellulose fibre before or during the shaping of the cylindrical rod.

In the case where the binder is a thermosealing solid and is in particular formed by fibres, the filtering mass shaped into a cylindrical rod is heated to a temperature corresponding to the softening zone of the binder but within its complete melting temperature so as to benefit from its adhesive properties and create multiple connection zones at the crossing points of the cellulose fibres. These fibre-to-fibre connections, achieved hot within the fibrous mass, consolidate the filtering structure after cooling so that it is possible to obtain a cigarette filter having a good compactness.

A process is known for producing a cigarette filter made from synthetic fibres of very small diameter dispersed with fibres which have a substantially larger diameter and are in a predominant proportion. At least one of the types of fibres is thermosensitive so that a subsequent heating is necessary to activate the binder constituted by said fibres and result in adhesion of all fibres at their crossing points.

Although these various processes provide filters having a good compactness by the mutual adhesion of the fibres of the different types employed, after the cooling of the fibrous mass following the heating thereof, it is however not possible to impart to the structure obtained the sufficient degree of permeability to air and to smoke owing to the fact that no porous network is created.

These processes indeed provide a compact end which is excessively little permeable to air and smoke, which renders the drawing of puffs difficult for the smoker. Moreover, the filtering efficiency as concerns harmful products of the tobacco smoke is insufficient owing to the fact that many fibres are stuck to each other, which reduces their area of contact with the smoke.

The present invention remedies these drawbacks and relates to a process for obtaining a filtering structure, in particular for cigarette filters, which is compact, permeable and absorbent, from a homogeneous mixture of fibrous material of at least two different types, one of which necessarily belongs to the family of thermofusible synthetic fibres.

The invention more particularly relates to a process for producing a filtering structure, in particular for cigarette filters, from a fibrous mass constituted by a homogeneous mixture of fibres of different types, some of which are necessarily thermofusible synthetic fibres, i.e. fibres having a low melting point and having adhesive properties in the molten state, whereas the other fibres are absorbent relative to the harmful product of the tobacco smoke and stable at the melting temperature of the thermofusible fibres, said fibrous mixture being shaped into a cylindrical rod in a state which is not yet coherent but homogeneous and comprises fibrous networks which are closely imbricated with respect to each other, said process comprising employing a notable proportion of thermofusible fibres relative to the absorbent fibres, bringing the fibrous mixture to a temperature which leaves the absorbent fibres intact but is sufficiently elevated to melt and fluidize all the thermofusible substance which was initially present in the form of fibres and is transformed into fine droplets dispersed in the network of absorbent fibres, thereby creating by this transformation, on one hand, multiple connections at the crossing points of the absorbent fibres which remain stable and, on the other hand, a network of pores which intercommunicate in all direction, this network being formed in the empty spaces left by the melting of the thermofusible fibres.

The invention will be further appreciated from the Figures of the drawings in which.

The fibrous mixture commences by being evenly distributed in a passageway of cylindrical shape. After its shaping in a state which is not yet coherent, it is subjected to an energetic heat treatment whereby it is possible to very rapidly melt the thermofusible fibres and thereby wholly transform them into fine adhesive droplets which weld the absorbent fibres to each other which remain intact and furthermore create a network of interconnected pores.

The originality of the process of the invention essentially resides in the complete destruction, by fusion of the fibrous form of the network of synthetic fibres. By the use of the properties of thermofusibility and adhesiveness of these fibres, there is formed the desired filtering structure which is remarkable for its cohesion, its compactness and its permeability.

After cooling, the structure is indeed coherent and compact owing to the presence of multiple zones of connections formed by the droplets of solidified fusible substance located at the crossing points of the absorbent fibres which are maintained intact.

The structure is moreover permeable owing to the formation of a network of interconnected pores. These pores are formed in the spaces left empty by the disappearance of the fibrous form of the thermofusible fibres and they are evenly distributed in this new structure. This structure is therefore created at the expense of the surface area of the thermofusible material, which permits an increase in the useful specific surface area of the absorbent fibres and reaching a high filtration efficiency.

Figure 1:
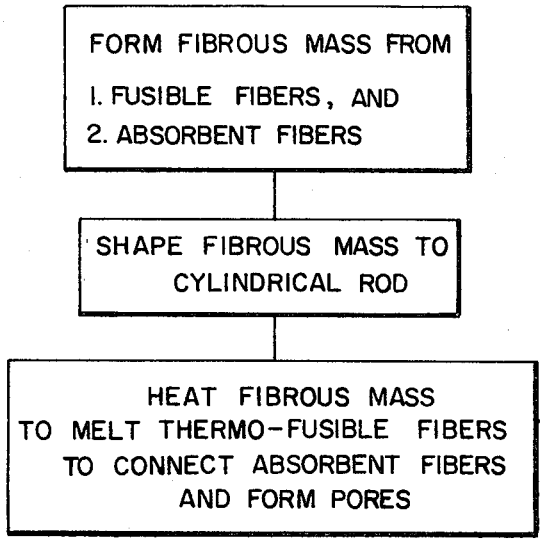
FIG. 1 is a block diagram illustrating the steps of the process.
Figure 2:
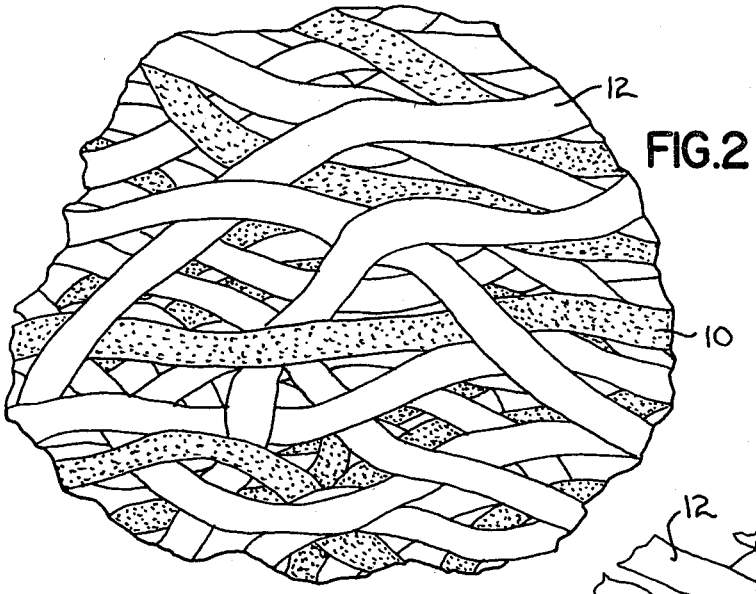
FIG. 2 is a partial view showing the filter prior to heating.
Figure 3:
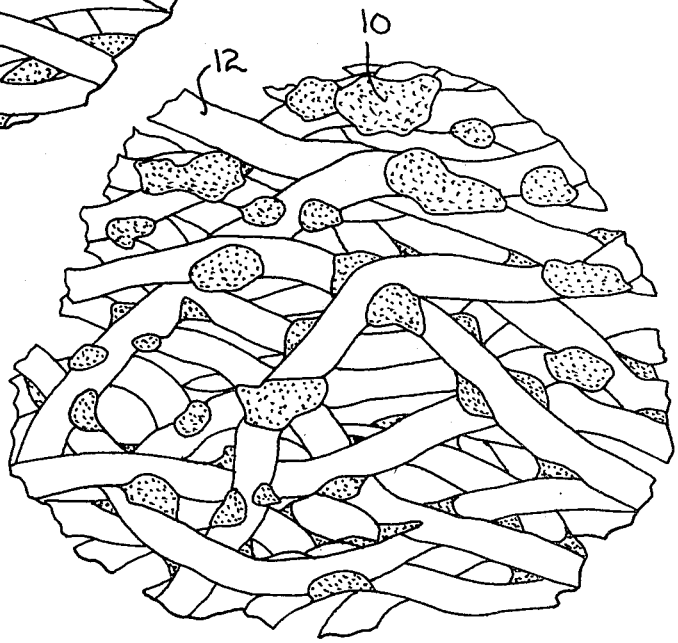
FIG. 3 is a partial view showing the filter after heating.

The thermofusible fibres, shown as 10 in FIGS. 2 and 3, may be chosen advantageously from polyolefin fibres in particular polyethylene, whose relatively low melting point is between 115° and 135° C.

Among the fibres of this family, high density polyethylene fibrillated fibres for paper use are particularly advantageous. These are fibres whose dimensions are close to those of cellulose. They are formed from very fibrillated and very abundant fibrous bunches having a very irregular and very hairy surface with a high specific area. Their lengths is between 1 and 2 mm and their diameter between 2 and 25 microns. This particular morphology permits an excellent intermingling with the cellulose fibres; it moreover permits, after the complete fusion of the polyethylene, obtaining a finely divided porous state, i.e. comprising a large number of micropores resulting from the considerable initial abundance of the fibrillated fibres. Owing to the process for obtaining them, these fibres do not have, upon their fusion, a large internal tension, which is particularly advantageous since the dimensions of the filtering rod obtained, in particular the diameter, are substantially the same before and after the heating of the fibrous mass.

There may also be employed as thermofusible fibres, fine filaments, for example of polyethylene, obtained by conventional spinning and cut into short segments. However, the characteristics of the filtering structure obtained are not as satisfactory as those acquired with fibrillated fibres.

Among the families of absorbent fibres shown as 12 in FIGS. 2 and 3, which are heat stable at the melting temperature of the thermofusible fibres of polyethylene, there may be employed wood cellulose fibres, namely fir, pine, picea tree fibres, or foliage wood, birch, oak, eucalyptus wood fibres, etc. . . . Owing to their morphology, these natural fibres although not fibrillated, have a high absorbent power relative to the tars of tobacco smoke. They are also of interest owing to their cheapness.

Cotton linters fibres may also be employed.

There may also be employed as absorbent fibres, the fibres obtained by cutting artificial or synthetic threads, for example threads of cellulose acetate. Their length and their diameter must be of the same order of magnitude as those of cellulose fibres and their melting temperature must be substantially higher than that of the thermofusible fibres.

There may also be employed, at any rate partly, as absorbent fibres activated carbon fibres whose length and diameter are close to those of cellulose fibres. In this way, benefit is had of a well-known power of activated carbon of absorbing the components of the gas phase and vapours of tobacco smoke.

The proportion by weight of the fibres of each type varies in accordance with the degree of aeration required for the filtering structure, i.e. its permeability to the stream of smoke. It is essential that the thermofusible fibres be in a notable amount (at least 25% of the fibrous mass) relative to the absorbent fibres so that the network of pores created by the melting of the thermofusible fibres sufficiently airs the filtering structure. The proportion of thermofusible fibres also enables the degree of compactness of the filter to be varied.

The proportion and the nature of the absorbent fibres contribute to the determination of the degree of efficiency of the filtering structure. The use of foliage wood fibres instead of fir tree fibres will give, everything else being equal, a lower permeability, less compactness and a higher efficiency.

Thus, by way of example, it can be shown that, for a filter of given density, by increasing the proportion of thermofusible synthetic fibres, the resistance to drawing and the efficiency of the filtration decreases while the compactness increases. Inversely, by increasing the proportion of absorbent fibres, the resistance to drawing and the efficiency of the filtration increases whereas the compactness decreases.

Furthermore, for a fibrous mixture of given composition, it appears that, by increasing the filling density of the cylindrical rod, the characteristics of resistance to drawing, efficiency of filtration and compactness increases.

In a preferred embodiment, for a mixture comprising 50% of thermofusible fibres and 50% of cellulose fibres, the range of variation of the density of the filter is 0.105–0.150. This corresponds to a range of resistance to drawing of 50 mm C.E.–150 mm C.E. for a filter tip of 8 mm×20 mm format.

Another embodiment is the following: a mixture containing ⅓ of cellulose fibres, ⅓ of activated carbon fibres and ⅓ of thermofusible fibres will give a sufficiently compact permeable filter which is very efficient in the retention of both tars and the gas phase and vapour of the tobacco smoke.

After its shaping into a cylindrical rod, the fibrous mass is heated by any suitable known means, such as a circulation of hot air, infra-red radiation, heating by high frequency or micro-waves. In any case, the manner of heating employed must be such that all the thermofusible fibres of the cylindrical rod reach their melting point at the same time.

The present invention provides, in respect of the cigarette filters obtained, the following advantages:

- excellent yield of the filtering material: for a given efficiency of filtration of the harmful products of tobacco smoke, a density which is substantially lower than of filters usually employed, filters of cellulose acetate or paper filters;
- possibility of obtaining an efficiency of the filters with respect to the gas phase and vapour of smoke by using activated carbon fibres;
- great facility of obtainment of a wide range of efficiency and compactness by acting on the nature and dimensions of the heat stable absorbent fibres, on the degree of utilization of the thermofusible fibres, and on the density of the filling of the rod;
- excellent compactness and excellent elasticity before and during the smoking operation, these two characteristics attaining degrees substantially higher than those of a filter of cellulose acetate having the same resistance to drawing;
- a satisfactory appearance of the section of the filter which has no visible pores but, on the contrary, an evenness similar to that of the cellulose acetate filter;
- advantageous cost relative to the cellulose acetate filter or paper filter, owing to the relatively low cost of the fibrous material of the mixture employed.

I claim:

1. In a process for producing a filtering structure, in particular for cigarette filters, comprising, mixing fibres of different types to form a homogeneous fibrous mass, one type of the fibres being synthetic and thermofusible at a low melting point and possessing adhesive properties in the molten state, another type of the fibres being absorbent with respect to harmful products of tobacco smoke and stable at the melting temperature of the thermofusible fibres, shaping the fibrous mass into a cylindrical rod which is not yet in a coherent state but is homogeneous and comprises fibrous networks which are closely imbricated relative to each other, the improvement comprising: employing a notable proportion of the thermofusible fibres relative to the absorbent fibres, said thermofusible fibres being elongated in form; and heating the fibrous mixture in said rod to a temperature which leaves the absorbent fibres intact but is sufficiently high for completely melting and fluidifying all the thermofusible substance which is initially present in the form of the elongated fibres to convert same into fine droplets dispersed in the network of absorbent fibres so as to create, by this conversion, on one hand, multiple connection at crossing points of the absorbent fibres which remain stable and, on the other hand, a network of pores which intercommunicate in all directions and are constituted by spaces left empty upon the complete melting of the thermofusible fibres.

2. A process as claimed in claim 1, further defined as employing a single type of absorbent fibres.

3. A process as claimed in claim 1, further defined as employing at least two types of absorbent fibres of different nature.

4. A process as claimed in claim 1, wherein the thermofusible fibres are polyolefin fibres.

5. A process as claimed in claim 4, wherein the polyolefin fibres are fibrillated fibres of high-density polyethylene for paper use assembled in very fibrillated and very abundant fibrous bundles having a very irregular and very hairy surface of high specific area, the main length of said fibres varying between 1 and 2 mm and their diameter varying between 2 and 25 microns.

6. A process as claimed in claim 1, wherein wood cellulose fibres are employed as the absorbent fibres.

7. A process as claimed in claim 1, wherein at least one of cotton fibres, activated carbon fibres, and short segments of cellulose acetate threads are employed as the absorbent fibres, said fibres and threads having a length and a diameter of the same order of magnitude as those of wood cellulose fibres.

8. A process as claimed in claim 1, wherein short segments of threads of synthetic substance are employed as the absorbent fibres whose melting point is distinctly higher than that of the thermofusible fibres.

9. A process as claimed in claim 8, wherein said synthetic substance is polypropylene.

10. A process as claimed in any one of the claims 1, 2 or 3, further defined as employing fibrous mass comprising at least 25% of thermofusible fibres.

11. A process as claimed in any one of the claims 1, 2 or 3, further defined as employing 50% of fibrillated fibres of high density polyethylene for paper use and 50% of pine cellulose fibres, the characteristics of shape, fineness and overall size of these fibres imparting a low density to the fibrous mass after the shaping thereof.

12. A filter for cigarettes, said filter being originally formed of a homogeneous fibrous mass of different types of fibers closely imbricated relative to each other, one type of fibres being elongated and comprising polyolefin material thermofusible at a low melting point and possessing adhesive properties in the molten state, the polyolefin fibres being fibrillated fibres of high-density polyethylene for paper use assembled in very fibrillated and very abundant fibrous bundles having a very irregular and very hairy surface of high specific area, the main length of said fibres varying between 1 and 2 mm and their diameter varying between 2 and 25 microns, another type of fibre being absorbent with respect to the harmful products of tobacco smoke and stable at the melting temperature of the thermofusible fibres, said mass containing a notable portion of thermofusible fibres relative to the absorbent fibres, said mass being shaped into a rod-like form and having been converted, by exposure to a temperature greater than the melting temperature of the elongated thermofusible fibres, to one in which fine droplets of said synthetic material are dispersed among the absorbent fibres to form multiple connections at crossing points, said mass containing a network of pores intercommunicating in all directions and formed of the speces left empty upon the complete melting of the thermofusible fibres.

13. A filter as claimed in claim 12 wherein a single type of absorbent fibres are employed in the fibrous mass.

14. A process as claimed in claim 12 wherein at least two types of absorbent fibres of different nature are employed in the fibrous mass.

15. A filter as claimed in claim 12 wherein said wood cellulose fibres are employed as the absorbent fibres.

16. A filter as claimed in claim 12 wherein at least one of cotton fibres, activated carbon fibres, and short segments of cellulose acetate threads are employed as the absorbent fibres, said fibres and threads having a length and a diameter of the same order of the magnitude as those of wood cellulose fibres.

17. A filter as claimed in claim 12 wherein short segments of threads of synthetic substance are employed as the absorbent fibres, the melting point of which is distinctly higher than that of the thermofusible fibres.

18. A filter as claimed in any one of claims 12, 13, or 14 wherein said fibrous mass comprises at least 25% of thermofusible fibres.

19. A filter for cigarettes, said filter being originally formed of a homogeneous fibrous mass of different types of fibres closely imbricated relative to each other, one type of fibres being elongated and comprising synthetic material thermofusible at a low melting point and possessing adhesive properties in the molten state, another type of fibre being absorbent with respect to the harmful products of tobacco smoke and stable at the melting temperature of the thermofusible fibres, said mass containing a notable portion of thermofusible fibres relative to the absorbent fibres, said mass being shaped into a rod-like form and having been converted, by exposure to a temperature greater than the melting temperature of the elongated thermofusible fibres, to one in which fine droplets of said synthetic material are dispersed among the absorbent fibres to form multiple connections at crossing points, said mass containing a network of pores intercommunicating in all directions and formed of the spaces left empty upon the complete melting of the thermofusible fibres, said fibrous mass comprising 50% fibrillated fibres of high-density polyethylene for paper use and 50% pine cellulose fibres, the characteristics of shape, fineness, and overall size of these fibres imparting a low density to the fibrous mass after the shaping thereof.

* * * * *